US008023669B2

(12) United States Patent
Segev et al.

(10) Patent No.: US 8,023,669 B2
(45) Date of Patent: Sep. 20, 2011

(54) SHIELDED COMMUNICATION TRANSDUCER

(75) Inventors: Mordechay Segev, Haifa (IL); Zvika Katz, Mazkeret Batya (IL)

(73) Assignee: Technion Research and Development Foundation Ltd., Haifa (IL)

( * ) Notice: Subject to any disclaimer, the term of this patent is extended or adjusted under 35 U.S.C. 154(b) by 277 days.

(21) Appl. No.: 11/922,022

(22) PCT Filed: Dec. 7, 2005

(86) PCT No.: PCT/IL2005/001321

§ 371 (c)(1),
(2), (4) Date: Nov. 25, 2009

(87) PCT Pub. No.: WO2006/134586

PCT Pub. Date: Dec. 21, 2006

(65) Prior Publication Data

US 2010/0061562 A1 Mar. 11, 2010

Related U.S. Application Data

(60) Provisional application No. 60/689,567, filed on Jun. 13, 2005.

(51) Int. Cl.
*H04R 25/00* (2006.01)
*H04R 9/08* (2006.01)

(52) U.S. Cl. ..... 381/172; 381/326

(58) Field of Classification Search ..... 381/71.1, 381/71.2, 71.6, 71.7, 170, 172, 326, 369, 381/380; 367/149

See application file for complete search history.

(56) References Cited

U.S. PATENT DOCUMENTS

| | | | | |
|---|---|---|---|---|
| 5,228,092 | A | 7/1993 | Nakamura et al. | |
| 5,327,506 | A | 7/1994 | Stites, III | |
| 5,757,934 | A | 5/1998 | Yokoi | |
| 6,104,816 | A | 8/2000 | Downs, Jr. et al. | |
| 6,408,081 | B1 | 6/2002 | Boesen | |
| 6,463,157 | B1 | 10/2002 | May | |
| 6,668,065 | B2 | 12/2003 | Lee et al. | |
| 6,731,570 | B1 * | 5/2004 | Langdon | 367/149 |
| 7,128,714 | B1 * | 10/2006 | Antonelli et al. | 600/481 |

OTHER PUBLICATIONS

International Search Report for International Application No. PCT/IL05/01321 mailed Sep. 25, 2007.

* cited by examiner

*Primary Examiner* — Brian Ensey

(74) *Attorney, Agent, or Firm* — Pearl Cohen Zedek Latzer, LLP

(57) ABSTRACT

A system and method for detecting a sound originating from a body and enhancing signal-to-noise ratio with respect to noise originated outside the body is disclosed. The system comprises a light source for producing a quasi-monochromatic, spatially-coherent light beam; and interferometer for interfering alight beam originated from the source, incident upon the body and reflected from it, with a reference beam, which also originates from the light source; and a detector for detecting changes caused by motion of a least one interference fringe across the detector, and for generation a corresponding electric signal.

20 Claims, 4 Drawing Sheets

SHIELDED COMMUNICATION TRANSDUCER

CROSS-REFERENCE TO RELATED APPLICATIONS

This application is a National Phase Application of PCT International Application No. PCT/IL2005/001321, entitled "Shielded Communication Transducer", International Filing Date Dec. 7, 2005, published on Dec. 21, 2006 as International Publication No. WO 2006/134586, which in turn claims priority from U.S. Provisional Patent Application No. 60/689,567, filed Jun. 13, 2005, both of which are incorporated herein by reference in their entirety.

FIELD OF THE INVENTION

The present invention relates to noise reduction and filtering. More particularly it relates to a system and a method for detecting a sound originating from a body and enhancing signal-to-noise ratio with respect to noise originated outside the body.

BACKGROUND OF THE INVENTION

Cellular phones have become a major means of communication, in both the private and the business sectors. Almost all cell-phone subscribers use a car speaker-phone or a mobile speaker-phone with an earphone, to facilitate cell-phone communication while performing other tasks, including also driving. To-date, even state of the art speaker-phones detect and transmit not only the user's voice (which is what they are designed to do), but also background noises, such as traffic noises (busses, cars), engine noises, air-conditioner noises, and sometimes even just pieces of background conversations (especially while using the cell-phone in a restaurant or in a car). These background noises are amplified and transmitted in the cellular communication system. In many cases, these undesired noises overwhelm the system to a degree that the transmitted voice of the speaker is unrecognizable anymore. Furthermore, background noises occupy an unnecessary fraction of the bandwidth of the transmitted information. As internet applications become incorporated in cellular phone technology, bandwidth will become essential and increasingly expensive. For all of these reasons, it will be of a major importance if one could construct a speaker-phone/earphone system that will be somehow shielded from background noises.

Bone conduction and in particular the human skull is known to be transmitting very efficiently sound waves generated within the skull (that is the voice of that human). Several attempts were made at utilizing this phenomenon for noise reduction.

In U.S. Pat. No. 5,228,092 (Nakamura et al.) a voice transducer is disclosed, used for telecommunication by a telephone installed in a motor vehicle or the like, including: a main body having a side surface to be contacted with an operator's head so as to detect vibrations of produced voice waves when they are transmitted through the skull of the head, and convert them into electric signals; a holder member of the main body; and a connecting member which connects the main body to the holder member in such a manner that the position of the side surface of the main body with respect to the operator's head can be adjusted. The main body includes a piezoelectric transducer to detect the vibrations, a damper material which surrounds the piezoelectric transducer, and a casing which surrounds the damper material and includes the side surface to be contacted with the operator's head, and the side surface of the casing is pre-treated to have a small coefficient of friction. The proposed transducer aims at solving problems of output voltage drop and drastic deterioration of the S/N ratio which are induced by unfavorable contact between the voice transducer and the operator's head or by unnecessary vibrations which are generated by friction between the operator's hair and the voice transducer.

U.S. Pat. No. 6,408,081 (Boesen) discloses a voice sound transmitting unit having an earpiece that is adapted for insertion into the external auditory canal of a user, the earpiece having both a bone conduction sensor and an air conduction sensor. The bone conduction sensor is adapted to contact a portion of the external auditory canal to convert bone vibrations of voice sound information into electrical signals. The air conduction sensor resides within the auditory canal and converts air vibrations of the voice sound information into electrical signals. In its preferred form, a speech processor samples output from the bone conduction sensor and the air conduction sensor to filter noise and select the a pure voice sound signal for transmission. The transmission of the voice sound signal may be through a wireless linkage and may also be equipped with a speaker and receiver to enable two-way communication.

U.S. Pat. No. 6,668,065 (Lee et al.) discloses a bone-conduction transducer comprising a plate-shaped yoke bent to form a pair of cut portions at both ends thereof; voice coils fitted to a center extension of the cut portions; a magnet and a plate of rectangular parallelepiped shape disposed between the voice coils; and a diaphragm minutely spaced from a lower part of the plate.

Other bone-conduction devices are disclosed in U.S. Pat. No. 6,463,157, U.S. Pat. No. 6,104,816, U.S. Pat. No. 5,757,934, U.S. Pat. No. 5,327,506.

It is an object of the present invention to provide a novel transducer that utilizes the bone-conduction phenomenon.

Another object of the present invention is to provide such transducer that employs optical means (with no need for acoustic detection) to detect the audio signal conducted through the skull of a person talking into his telecommunication device (in particular, but not only, cellular phone).

Another object of the present invention is to use optical means to detect audio signals generated in the human body, such as heart beats, sounds generated in the lungs, and blood flow.

Yet another object of the present invention is to provide a shielded communication device that can be used to detect and enhance sounds originating from within any body that has an acoustically excitable surface, and ignore or greatly reduce background noises.

SUMMARY OF THE INVENTION

There is thus provided, in accordance with some preferred embodiments of the present invention, a system for detecting a sound originating from a body and enhancing signal-to-noise ratio with respect to noise originated outside the body, the system comprising:

a light source for producing a quasi-monochromatic, spatially-coherent light beam;

an interferometer for interfering a light beam originated from the source, incident upon the body and reflected from it (henceforth the "signal beam"), with a reference beam, which also originates from the light source; and a detector for detecting changes caused by motion of at least one interference fringe across the detector, and for generating a corresponding electric signal.

Furthermore, in accordance with some preferred embodiments of the present invention, the light source is a laser source.

Furthermore, in accordance with some preferred embodiments of the present invention, the light source is characterized as having a coherence length exceeding an optical round trip in the system.

Furthermore, in accordance with some preferred embodiments of the present invention, the detector has a response rate equal or faster than 25 kHz.

Furthermore, in accordance with some preferred embodiments of the present invention, a mirror is included in the interferometer for reflecting the reference beam, wherein the mirror has a surface roughness simulating divergence of the beam reflected off the body.

Furthermore, in accordance with some preferred embodiments of the present invention, the system further comprises a lens situated before the detector for optimizing the size of a single interference fringe to match a detection area of the detector.

Furthermore, in accordance with some preferred embodiments of the present invention, the interferometer comprises two quarter wave plates and two polarizers to optimize optical power in the interference signal reaching the detector in the system.

Furthermore, in accordance with some preferred embodiments of the present invention, the reference beam is also directed onto the body (instead of the mirror), then reflected off the body, and then interfered with the signal beam, facilitating a differential detection scheme.

Furthermore, in accordance with some preferred embodiments of the present invention, the distance between the two beams reflected off the body is on the order of one or two sound wavelengths of the sound to be detected.

Furthermore, in accordance with some preferred embodiments of the present invention, the system is incorporated in a device to be worn over an ear of a user, and adapted to direct the light beam incident upon the body towards the skull of the user.

Furthermore, in accordance with some preferred embodiments of the present invention, the device comprises an earpiece.

Furthermore, in accordance with some preferred embodiments of the present invention, the system is further provided with a reflective patch to be coupled to the surface for enhanced acoustic coupling.

Furthermore, in accordance with some preferred embodiments of the present invention, there is provided a method for detecting a sound originating from a body and enhancing signal-to-noise ratio with respect to noise originated outside the body, the method comprising:

directing a light beam from a light source producing a quasi-monochromatic, spatially-coherent light beam onto the body;

collecting a reflected light from the body and interfering it with a reference beam that is also originated from the light source; and detecting moving interference fringes of the interfering light beams by an optical detector detecting changes caused by motion of at least one interference fringe across the detector, and for generating a corresponding electric signal.

Furthermore, in accordance with some preferred embodiments of the present invention, the body is a human body and the sound is a human voice.

Furthermore, in accordance with some preferred embodiments of the present invention, the light beam is characterized as having a coherence length exceeding an optical round trip in the system.

Furthermore, in accordance with some preferred embodiments of the present invention, the reference beam is reflected off a mirror having a surface roughness simulating divergence of the beam reflected off the body.

Furthermore, in accordance with some preferred embodiments of the present invention, the method further comprises beam shaping before the detector for optimizing the size of a single interference fringe to match a detection area of the detector.

Furthermore, in accordance with some preferred embodiments of the present invention, the reference beam is directed onto the body and reflected off the body.

Furthermore, in accordance with some preferred embodiments of the present invention, the distance between the two beams reflected off the body is on the order of one or two sound wavelengths of the sound to be detected.

Furthermore, in accordance with some preferred embodiments of the present invention, the method further comprises providing a reflective patch to be coupled to the surface for enhanced acoustic coupling.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

DETAILED DESCRIPTION OF PREFERRED EMBODIMENTS

Figure 1:
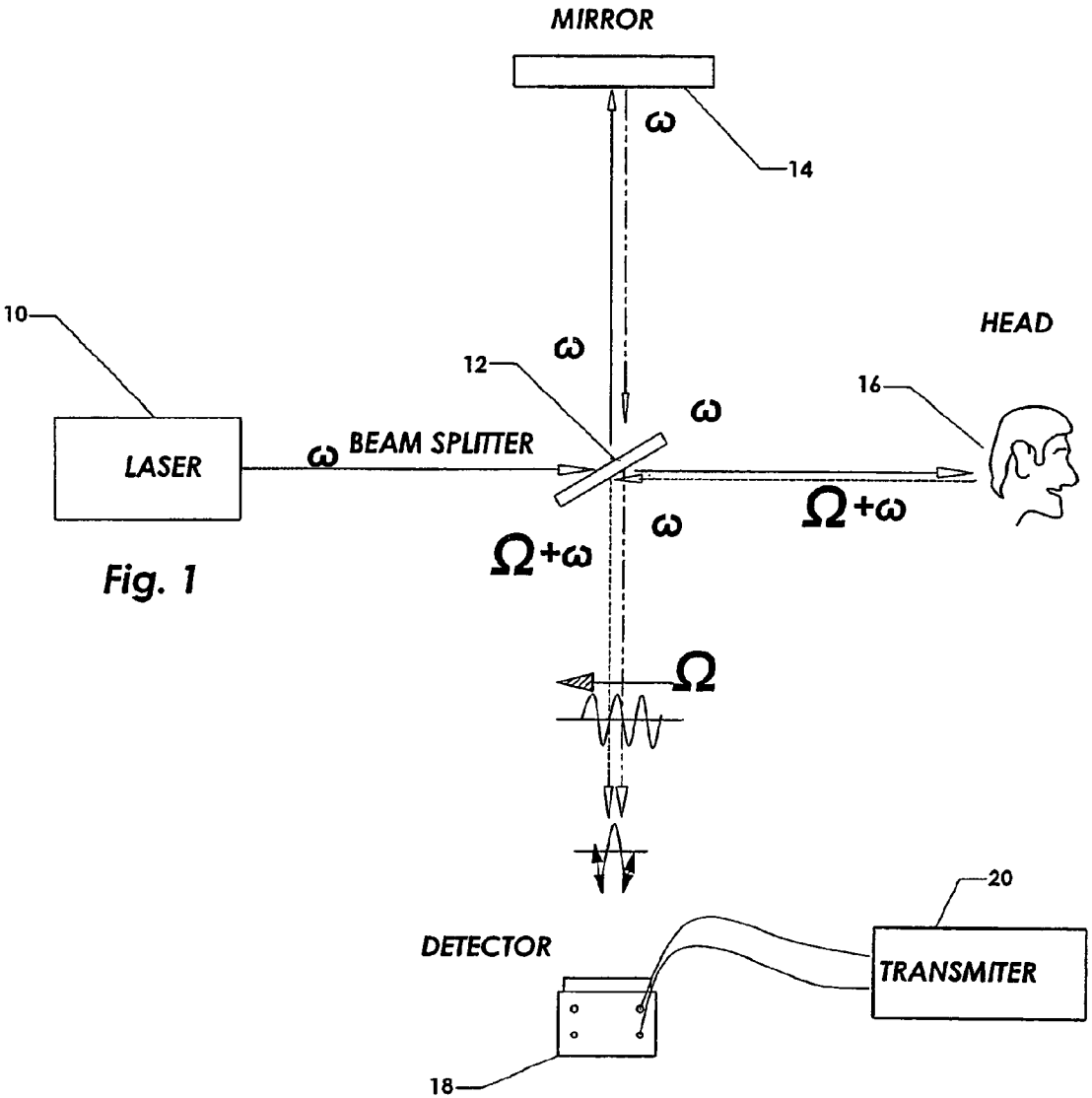
FIG. 1 illustrates a shielded communication transducer in accordance with a preferred embodiment of the present invention.

A main aspect of the present invention is shielding background noises based on natural shielding by exploiting sound waves that propagate internally in the skull of the user. It is very well known that sound conduction is greatly improved in a dense medium (for example, sound conduction is better in water than in air). In the case of a cell-phone user, the sound wave is generated in his throat and sound chords. This sound wave (henceforth "the signal"), apart from being transmitted through the air (by transferring the vibrations of the sound chords to air vibrations), is also transmitted via sound conduction through the skull bone and cartilage and it is eventually detected by the user's internal ear. As is well known, a person always hears himself better than he hears background noises and other speakers (except for extreme situations where the amplitude of the background noise is many orders of magnitude above the amplitude of the "signal"). This means that the skull itself serves as a very good isolator that naturally shields the internally-conducted sound wave from external background noises. The proposed device and method of the present invention rely of this fact by performing detection that collects the signal directly from the sound vibration of the bone (or cartilage) in the skull. Since the sound signal is generated internally and reaches the external parts of the skull by sound conduction through the bone and cartilage, its amplitude is much higher than the amplitude of an external (background) noise that excites a low-amplitude sound wave when the respective air vibration reaches the user's head. Therefore, if one performs a direct detection of the signal by monitoring the sound wave conducted in the skull, he will find that the external noises contribute very little if any to the detected signal.

Direct detection from the skull is desirable, because if one uses a method that detects the sound wave carried in air, even very close to the mouth, he will find that the preferential advantage of the signal is diminished.

Key features of the present invention are therefore:

Sound conduction in the bone and cartilage of the skull, that prefers internally-excited sound waves on external noise; and Direct detection of the sound wave propagating in the skull.

It is important that the detection of the sound wave is direct: i.e., the signal has to be monitored and detected directly from the sound wave propagating in the skull, and not by detecting air vibrations around the user's head. For direct detection, the inventors of the present invention introduce a sophisticated yet convenient way to detect the sound wave right off the bones or cartilage of the skull. The proposed method is based on Laser-Doppler detection, which seems to be, at the moment, the best method to do it. The idea is to use a very low power laser beam to illuminate a bone area. The illuminated spot reflects some of the laser light, and all the reflected light appears to be at a slightly different frequency than the original laser frequency. The frequency shift is the Doppler shift that results from adding (or subtracting) the sound wave frequency to the laser frequency when the sound wave is co-(counter-) propagating with the lightwave when the two waves coincide at the illuminated spot.

The bone area is preferably, in case of humans, any area of the skull, and in particular it seems that the area behind the ear, or the cartilage inside the ear, or any other point on the external part of the skull as long as it is not in a direct proximity of an air cavity (because such a cavity will give rise to standing waves which may distort the signal) will do.

The laser in use in a preferred embodiment of the present invention is a single-mode semiconductor laser with a coherence length preferably exceeding an optical round trip in the optical system (the optical path traveled in the system) that is included in a shielded communication device that preferably resides inside the handset of the phone, a cellular phone or on a headset (see FIG. 3) or is any other independent source. The laser light preferably reaches the illuminated spot on the head through an optical fiber equipped with a tiny collimator lens at its end. The sound-modulated laser light that is reflected from the illuminated spot on the head is then collected by the same lens and made to interfere with the reference lightwave, giving rise to interference fringes. Because the two lightwaves are now at slightly different frequencies, the interference fringes move, with their velocity proportional to the frequency difference between the lightwaves, which is, in turn, proportional to the velocity of the original signal sound wave. A tiny photo-detector may be placed so as to cover a single interference spot (speckle). The detector will show current when the bright interference fringe moves across it, with the current amplitude proportional to the audio signal, and the current frequency identical to the frequency of the audio signal. Some electronic signal processing is required to compensate for possible distortions and errors in the system, but a need is not foreseen of any major and sophisticated signal processing tasks. Compressing the detected signal (that is pure, with little to none of the stochastic information contents of the background noises) is optional. Such a data compression scheme, especially when calibrated to the voice of a particular user (say, the owner of the cell-phone), leaves a considerable part of the available bandwidth empty and lends it to internet communication or other complementary uses. Furthermore, according to some preferred embodiments of the present invention, this facilitates internet services simultaneously with speech transmission and detection. Finally, it is emphasized that the method and device of the present invention use no electronic devices or wires near the head of the user. All the detection process is carried out by laser light, which at the expected power levels (microwatts) and expected laser wavelength is totally harmless. It is a user-safe system that does not involve the risks of transmitting or receiving electrical microwave signals near the head.

New features and advantages of the proposed system include: Transmission of the user's voice, free from background noises; Detection that is very sensitive to the speaker's voice, but insensitive to other background noises; and Electronics-free components (no wires, microphones). Even the earphone converts an optical signal into a sound signal only in the ear, that is, there are no wires that can serve as harmful secondary antennae at the vicinity of the user's head. This renders cell-phone technology completely harmless.

The present invention facilitates enhancement of the signal to noise ratio for noise or sounds generated outside the body, because the noise generated outside the body has very weak acoustic coupling to the body, thus it is greatly attenuated and the effects on the reflected beam are greatly diminished.

The removal of background noises, together with data compression schemes, leaves a considerable part of the communication bandwidth empty and available for other tasks.

Reference is now made to FIG. 1, which is a schematic illustration of a preferred embodiment of the present invention. An interferometer is used to create interference between a laser beam reflected from the user's head carrying the signal and a reference beam (split by the beam splitter). A light source (preferably a laser beam source 10) generates a laser beam and irradiates it onto a beam splitter 12. The beam splitter splits the beam into two orthogonal beams: one arm of the beam is directed onto a mirror and reflected from that mirror and reaches a photo-detector 18 to serve as a reference beam, while the other arm of the beam traverses to the head 16 of the user and is reflected off it, and is redirected by the beam splitter 12 onto the detector. Originally, both beams are at the same frequency $\omega$. The reflected beam, which is now modulated by the sound wave, is at frequency $\omega+\Omega$, where $\Omega$ is the sound wave frequency. The reflected beam interferes with the reference beam, effectively subtracting both signals to obtain the detected acoustic signal $\Omega$. The detecting area of the detector, which is sensitive to optical signals is preferably selected to span across a single fringe, so as to effectively sense changes as that fringe travels across the detector. The detected signal is picked up by the detector in the form of a speckle that moves across the detector causing the detector to generate an electric current signal whose amplitude is proportional to the audio signal, and whose frequency is identical to the frequency of the audio signal.

Figure 2:
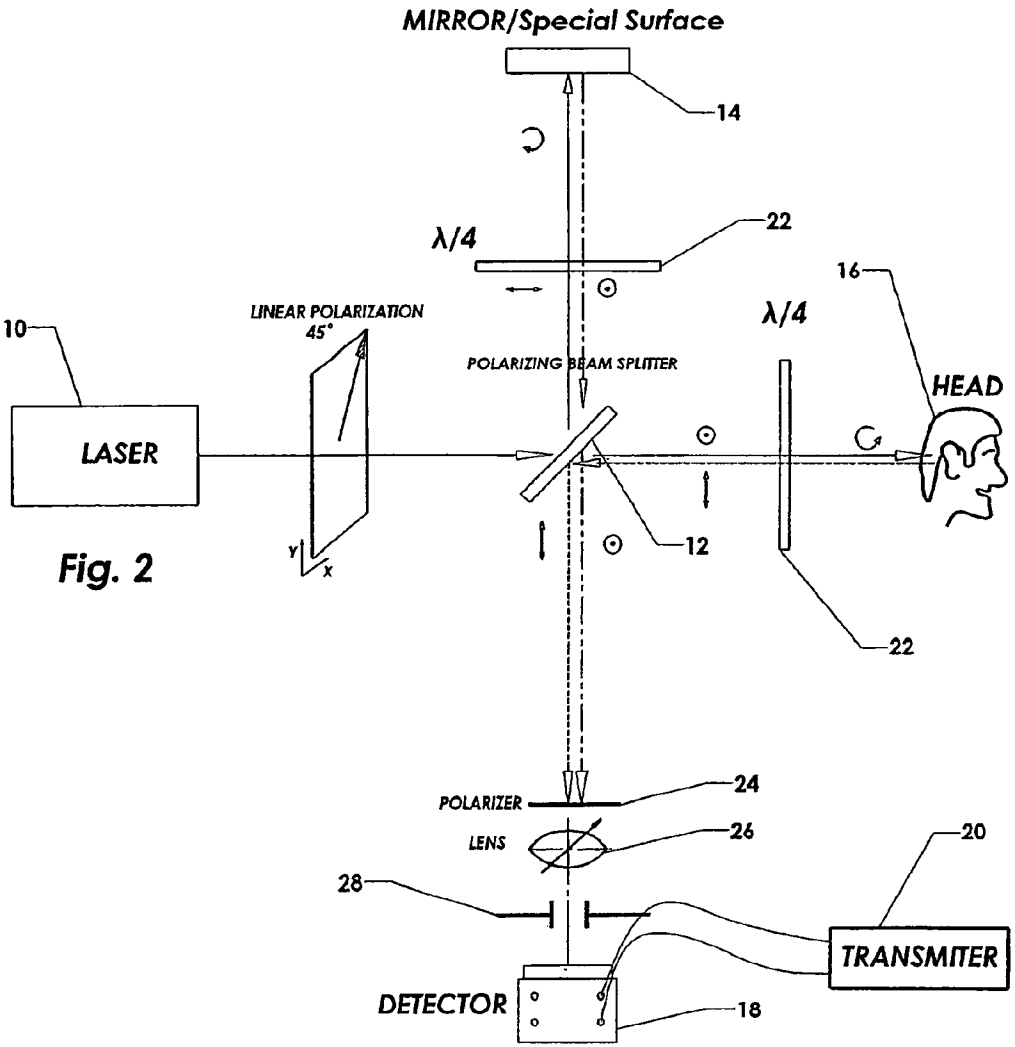
FIG. 2 illustrates a shielded communication transducer in accordance with another preferred embodiment of the present invention.

FIG. 2 illustrates another preferred embodiment of the present invention. The basic scheme relies on the scheme described in FIG. 1, into which two retardation plates 22

(quarter wave plates) are installed, one at each arm of the interferometer, and a polarizer 24 is placed just before the detector. This is suggested to ensure that maximal optical power emitted from the light source reaches the detector, with average intensities of the reflected beam and reference beam being substantially equal at the plane of the detector.

The laser source is generating a linearly-polarized beam (in this example the orientation of polarization is 45 degrees). The beam-splitter is replaced by a polarizing beam-splitter. In this scheme, maximum power is delivered to the output interference plane (no back reflections into the laser), hence the consumption of optical power is optimized. Optional lens 26 is used to focus the output beam onto the detector (with an optional slit or aperture 28 for ensuring that only one fringe of the interference pattern reaches the detector. For audio signals generated by a person talking the detector preferably has a response rate equal or faster than 25 kHz. The effective detection area of the detector should cover one (or a few) interference periods (fringes). The detector responds to the movement of interference fringes, whose highest rate is of the same frequency as the anticipated voice frequency. The detector converts the photon flux into electric current that mimics the temporal variations in the photon flux. The interference fringes move across the detector at the frequency of the sound to be detected.

Mirror 14 may preferably comprise a surface of same or similar reflecting qualities as the user's head skin, this is good for ensuring same or similar wave front properties of both the reference and the audio signal carrier beams. It is recommended that the surface roughness is same or very similar so as to simulate divergence of the beam reflected off the body. Painted surface, rough surface of same or similar roughness (same scale) may be considered. This is suggested in order to optimize the performance of the interferometer.

Figure 3:
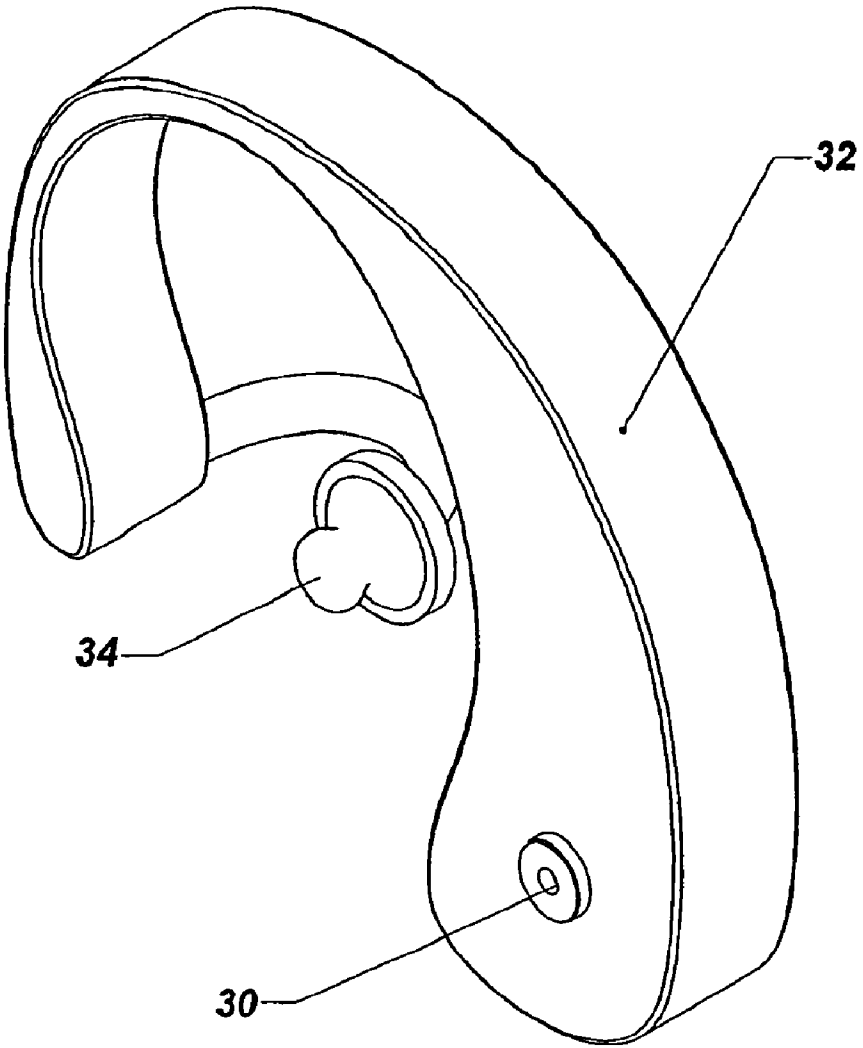
FIG. 3 illustrates an exemplary headset set-up incorporating a shielded communication transducer in accordance with a preferred embodiment of the present invention.

FIG. 3 illustrates incorporation of a detector device according to the present invention in a headset 32 (typically a headset using Bluetooth technology, with an earphone 34). The detection unit has a window 30, through which the laser beam is directed onto the user's head.

Figure 4:
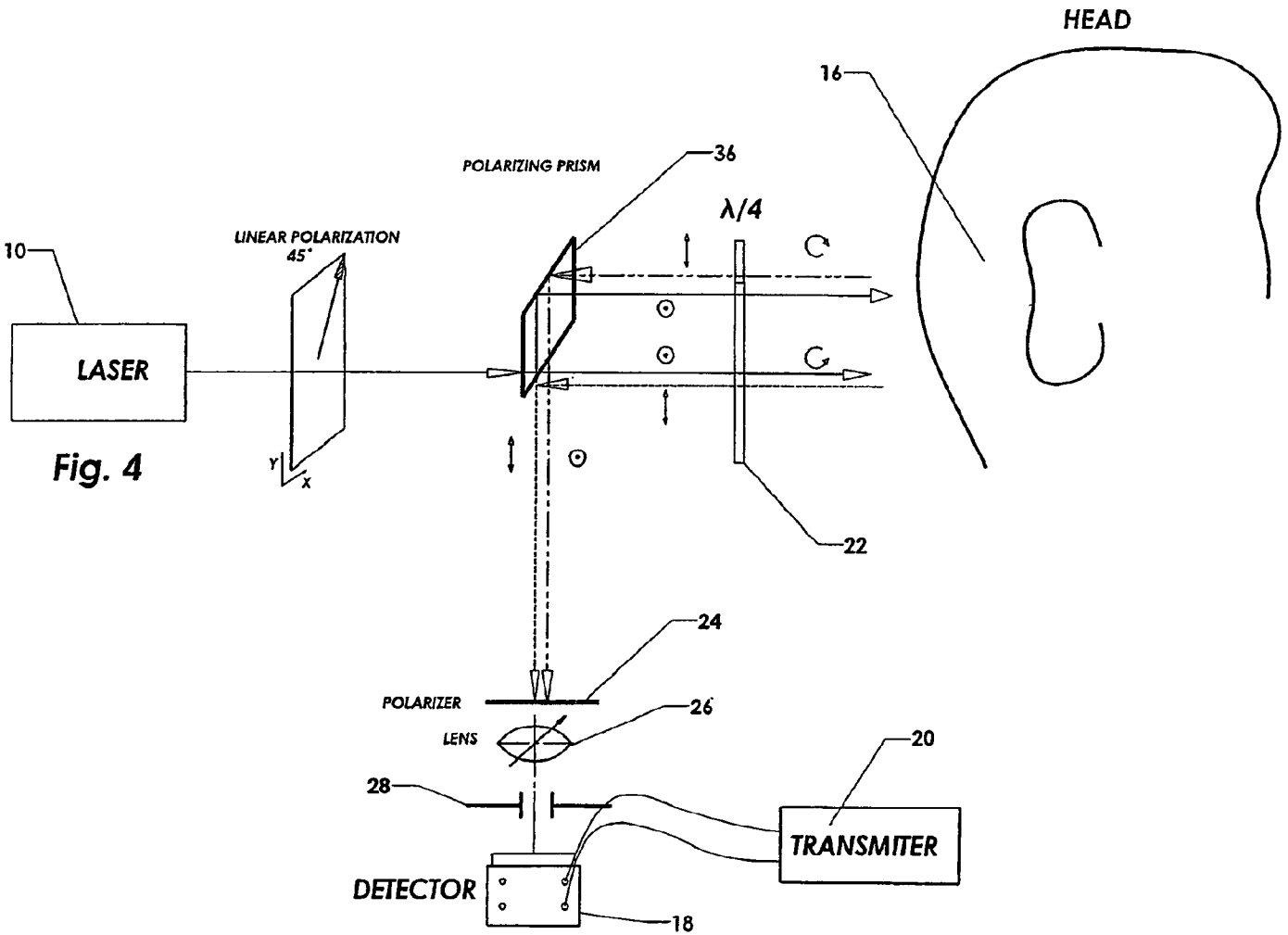
FIG. 4 illustrates a shielded communication transducer in accordance with another preferred embodiment of the present invention, directing both information and reference beams onto the user's head.

FIG. 4 illustrates a shielded communication transducer in accordance with another preferred embodiment of the present invention, directing both signal beam and reference beams onto the user's head. The optical scheme is similar to the one described with reference to FIG. 2, however a polarizing prism 36 replaces the polarizing beam splitter 12. This is used to irradiate both the audio-signal carrier beam and the reference beam onto the same skin surface, so as to obtain two reflected beams of same or close wave front properties that are associated with the same or similar reflection properties of the skin. It is recommended that the distance between the two beams reflected off the body be on the order of one or two sound wavelengths of the sound to be detected, so as to achieve differential detection. In some preferred embodiments of the present invention a reflective patch may be provided for positioning on the skin of the user, for enhanced acoustic coupling.

It is noted that while the embodiments discussed and described in the present specification relate to mobile phone communication by humans, the present invention has a much broader scope, and in fact may be implemented in detecting and enhancing sounds originating from within any body which has an external surface that can be excited by an internal sound, while shielding the obtained signal from external noise. The system and method of the present invention may be used in various applications and tasks. For example, it may be used to detect and monitor heart-beats. It may be incorporated in a pace-meter to be used by athletes. The system and method of the present invention may be used for voice recognition to detect and recognize voice signatures. It may also be used for underwater communication. Current conventional microphones may not be used underwater, as the membrane of conventional microphones is susceptible to water. The system and method of the present invention may also be used for remote detection of noises. It has added value and special appeal in noisy environments with stochastic noises (such as coal mines, airports, tanks and other vehicles).

It should be clear that the description of the embodiments and attached Figures set forth in this specification serves only for a better understanding of the invention, without limiting its scope.

It should also be clear that a person skilled in the art, after reading the present specification could make adjustments or amendments to the attached Figures and above described embodiments that would still be covered by the present invention.

The invention claimed is:

1. A system for detecting a sound originating from a body and enhancing signal-to-noise ratio with respect to noise originated outside the body, the system comprising:

a light source for producing a quasi-monochromatic, spatially-coherent light beam;

an interferometer for interfering a light beam originated from the source, incident upon the body and reflected from it, with a reference beam, which also originates from the light source; and a detector for detecting changes caused by motion of at least one interference fringe across the detector, and for generating a corresponding electric signal.

2. The system of claim 1, wherein the light source is a laser source.

3. The system of claim 1, wherein the light source is characterized as having a coherence length exceeding an optical round trip in the system.

4. The system of claim 1, wherein the detector has a response rate equal or faster than 25 kHz.

5. The system of claim 1, wherein a mirror is included in the interferometer for reflecting the reference beam, wherein the mirror has a surface roughness simulating divergence of the beam reflected off the body.

6. The system of claim 1, further comprising a lens situated before the detector for optimizing the size of a single interference fringe to match a detection area of the detector.

7. The system of claim 1, wherein the interferometer comprises two quarter wave plates and two polarizers to optimize the system.

8. The system of claim 1, wherein the reference beam is directed onto the body, The reference beam is reflected off the body.

9. The system of claim 8, wherein the distance between the two beams reflected off the body is on the order of one or two sound wavelengths of the sound to be detected.

10. The system of claim 1, incorporated in a device to be worn over an ear of a user, and adapted to direct the light beam incident upon the body towards the skull of the user.

11. The system of claim 10, wherein the device comprises an earpiece.

12. The system of claim 1, further provided with a reflective patch to be coupled to the surface for enhanced acoustic coupling.

13. A method for detecting a sound originating from a body and enhancing signal-to-noise ratio with respect to noise originated outside the body, the method comprising:

directing a light beam from a light source producing a quasi-monochromatic, spatially-coherent light beam onto the body;

collecting a reflected light from the body and interfering it with a reference beam that is also originated from the light source;

detecting moving interference fringes of the interfering light beams by an optical detector detecting changes caused by motion of interference fringes across the detector, and for generating a corresponding electric signal.

14. The method of claim 13, wherein the body is a human body and the sound is a human voice.

15. The method of claim 13, wherein the light beam is characterized as having a coherence length exceeding an optical round trip in the system.

16. The method of claim 13, wherein the reference beam is reflected off a mirror having a surface roughness simulating divergence of the beam reflected off the body.

17. The method of claim 13, further comprising beam shaping before the detector for optimizing the size of a single interference fringe to match a detection area of the detector.

18. The method of claim 13, wherein the reference beam is directed onto the body and reflected off the body.

19. The method of claim 18, wherein the distance between the two beams reflected off the body is on the order of one or two sound wavelengths of the sound to be detected.

20. The method of claim 13, further comprising providing a reflective patch to be coupled to the surface for enhanced acoustic coupling.

* * * * *